US012157154B2

(12) United States Patent
Chu et al.

(10) Patent No.: US 12,157,154 B2
(45) Date of Patent: Dec. 3, 2024

(54) METHOD FOR PREPARING HIGH-PERFORMANCE DIFFICULT-TO-DEFORM METAL PRECISION SEAMLESS PIPE

(71) Applicant: TAIYUAN UNIVERSITY OF SCIENCE AND TECHNOLOGY, Shanxi (CN)

(72) Inventors: Zhibing Chu, Shanxi (CN); Qianhua Yang, Shanxi (CN); Dong Wei, Shanxi (CN); Duo Zhang, Shanxi (CN); Chun Xue, Shanxi (CN); Xiaodong Zhao, Shanxi (CN); Yugui Li, Shanxi (CN)

(73) Assignee: TAIYUAN UNIVERSITY OF SCIENCE AND TECHNOLOGY, Shanxi (CN)

( * ) Notice: Subject to any disclaimer, the term of this patent is extended or adjusted under 35 U.S.C. 154(b) by 651 days.

(21) Appl. No.: 17/509,040

(22) Filed: Oct. 24, 2021

(65) Prior Publication Data

US 2022/0040742 A1 Feb. 10, 2022

Related U.S. Application Data

(63) Continuation of application No. PCT/CN2021/070206, filed on Jan. 5, 2021.

(30) Foreign Application Priority Data

Nov. 4, 2020 (CN) ..... 202011217905.6

(51) Int. Cl.
*B21B 19/04* (2006.01)

(52) U.S. Cl.
CPC ..... *B21B 19/04* (2013.01)

(58) Field of Classification Search
CPC ..... B21B 19/04; B21B 19/08; B21B 19/10; B21B 17/02; B21B 17/04; B21B 2015/0028; B21D 3/04; B21D 41/04
(Continued)

(56) References Cited

FOREIGN PATENT DOCUMENTS

CN 1919530 A * 2/2007
CN 107321814 A * 11/2017 ..... B21C 37/06
(Continued)

OTHER PUBLICATIONS

Machine translation of CN 107321814 (Year: 2017).*
(Continued)

*Primary Examiner* — Christopher L Templeton
*Assistant Examiner* — Teresa A Guthrie

(57) ABSTRACT

A method for preparing a high-performance difficult-to-deform metal precision seamless pipe includes steps of performing a heat treatment; drilling; externally grinding; internally grinding; straightening; performing four-roller warm-rolling; performing warm-drawing to reduce a diameter; performing warm-expansion to reduce a wall thickness and increase the diameter; performing precise cold-rolling; degreasing; brightening; performing surface grinding; cleaning dust; detecting flaws; testing metal structure performance; and sizing and packaging. By cycling the warm-drawing, the warm-expansion, and the precision cold-rolling, key indicators such as product dimensional accuracy, surface quality, material properties, and crystal grain size can be collaboratively controlled, to achieve higher accuracy, better performance, and more outstanding extreme specifications. Product requirements of different hard-to-deform metal materials and different product specifications can be satisfied, to flexibly prepare metal pipe
(Continued)

products with different material characteristics, which greatly improves production efficiency and effectively reduces production costs.

9 Claims, 7 Drawing Sheets

(58) Field of Classification Search
USPC ..... 72/97
See application file for complete search history.

(56) References Cited

FOREIGN PATENT DOCUMENTS

| | | | | | |
|---|---|---|---|---|---|
| CN | 107931331 | A | * | 4/2018 | ..... B21B 19/04 |
| CN | 108043885 | A | * | 5/2018 | ..... B21B 3/00 |
| CN | 110899335 | A | * | 3/2020 | |

OTHER PUBLICATIONS

Machine translation of CN 107931331 (Year: 2018).*
Machine translation of CN 108043885 (Year: 2018).*
Machine translation of CN 110899335 (Year: 2020).*
Machine translation of CN 1919530 (Year: 2007).*

* cited by examiner

METHOD FOR PREPARING HIGH-PERFORMANCE DIFFICULT-TO-DEFORM METAL PRECISION SEAMLESS PIPE

CROSS-REFERENCE OF RELATED APPLICATION

The application is a continuation application of a PCT application No. PCT/CN2021/070206, filed on Jan. 5, 2021; and claims the priority of Chinese Patent Application No. CN202011217905.6, filed to the China National Intellectual Property Administration (CNIPA) on Nov. 4, 2020, the entire content of which is incorporated hereby by reference.

BACKGROUND OF THE PRESENT INVENTION

Field of Invention

The present invention relates to metal processing technology, and more particularly to a method for preparing a high-performance difficult-to-deform metal precision seamless pipe.

Description of Related Arts

As a structural material and transportation teel, metal seamless pipes are widely used in the development of the national economy. With the continuous progress and development of modern science and technology, especially for the application requirements of seamless steel pipes, higher and, higher requirements are put forward for the material, size, and performance of metal pipes. Nickel-based alloys, high-strength steels, titanium alloys, zirconium alloys, molybdenum alloys, tungsten alloys, magnesium alloys, and other metal materials are typical representatives of difficult-to-deform metals. Because of excellent performance and life cycle, they are widely used in aerospace, marine engineering, weaponry equipment, nuclear industry, etc., which are important basic materials in the field of modern high-end equipment manufacturing.

Metal precision seamless pipes with high-performance and rare deformation made of the above-mentioned metal materials can satisfy harsh environmental conditions and have properties such as significant long service life and high performance, so the demands therefor are increasing year by year. With the upgrading of high-end equipment, higher and higher requirements have been put forward to the reliability, stability, and precision of the above products. Conventional preparation technology has problems such as high production cost, low efficiency, poor product performance, and low precision, which often includes: (1) centrifugally casting hollow billet→heating→forging→cooling→straightening→cutting head and tail→turning surface→heating→performing homogenization treatment→performing surface lubrication treatment→extruding→performing internal and external surface treatment→cold-rolling→annealing→cold-rolling and cold-drawing→performing heat treatment→straightening→pickling→cleaning; or (2) preparing solid billet→heating→forging→cooling→straightening→cutting head and tail→turning surface→heating→performing homogenization treatment→performing surface lubrication treatment→extruding→performing internal and external surface treatment→cold-rolling→annealing→cold-rolling and cold-drawing→performing heat treatment→straightening→pickling→cleaning. At the early stage of the above two methods, to obtain a finer crystal grain size and high metal plasticity, multiple forgings are required. However, the hammerhead runs slowly in the forging process and the efficiency is low, so it is necessary to enter the furnace for heating treatment and upsetting several times. If a cold-rolling mill is used for forming, due to its cold state forming, the deformation amount per a single pass of the difficult-to-deform metal is small, and a large number of deformation passes are needed. Furthermore, the wall thickness reduction may be insufficient, and process flexibility is poor. Therefore, it is difficult to achieve high efficiency and continuous production.

For the above-mentioned seamless pipes made of difficult-to-deform metal materials, there are conventionally few manufacturers that can mass-produce with stable product quality, reliable process stability, and continuous production capacity, which cannot meet the national economic development demand for seamless steel pipes of various specifications. As a result, there is an urgent need for a brand-new precision seamless pipe preparation method to satisfy conventional market production needs, and achieve the preparation requirements for difficult-to-deform metal pipes with a diameter of Φ3 mm-Φ800 mm and a wall thickness of 0.5 mm-30 mm.

SUMMARY OF THE PRESENT INVENTION

To overcome defects in the prior art, an object of the present invention is to provide a method for preparing a high-performance difficult-to-deform metal precision seamless pipe.

Accordingly, to accomplish the above objects, the present invention provides:

a method for preparing a high-performance difficult-to-deform metal precision seamless pipe, comprising steps of:

1) performing a heat treatment: heating a solid metal blank after sizing to reduce a metal resistance;

2) drilling: drilling a hole on the heated solid metal blank to obtain a hollow blank pipe;

3) externally grinding: grinding an external wall of the hollow blank pipe;

4) internally grinding: grinding an internal wall of the hollow blank pipe;

5) cleaning oil stains: cleaning the internal wall and the external wall of the ground hollow blank pipe;

6) straightening: straightening the cleaned hollow blank pipe to eliminate bending and collapse of the hollow blank pipe due to uneven metal strain distribution caused by drilling and grinding;

7) performing four-roller warm-rolling: processing the straightened hollow blank pipe with the four-roller warm-rolling to perform large-deformation isothermal-rolling, thereby obtaining a metal seamless pipe with a reduced diameter;

8) degreasing: degreasing the metal seamless pipe with the reduced diameter;

9) brightening: brightening the degreased metal seamless pipe;

10) performing surface grinding: processing the brightened metal seamless pipe with the surface grinding;

11) cleaning dust: cleaning the ground metal seamless pipe to obtain the high-performance difficult-to-deform metal seamless pipe;

12) detecting flaws: processing the high-performance difficult-to-deform metal seamless pipe with ultrasonic flaw detection and discarding unqualified high-performance difficult-to-deform metal seamless pipe;

13) testing metal structure performance: sampling the qualified high-performance difficult-to-deform metal seamless pipe and testing the metal structure performance; and repeating the steps 7-13 to the unqualified high-performance difficult-to-deform metal seamless pipe until the qualified high-performance difficult-to-deform metal seamless pipe is obtained; and 14) sizing and packaging: packaging the qualified high-performance difficult-to-deform metal seamless pipe.

Preferably, when a ratio of a diameter D to a wall thickness h of the metal seamless pipe with the reduced diameter obtained after the steps 1-7 is $10 \leq D/h \leq 15$, steps Z3 and Z4 are inserted after step 7 before performing the steps 8-14;

Z3) performing the heat treatment: processing the metal seamless pipe with the reduced diameter with the heat treatment; and Z4) performing precise cold-rolling: after the heat treatment, processing the metal seamless pipe with small-deformation cold-rolling by using a multi-roller cold-rolling technology, to obtain a higher pipe dimensional accuracy and a finer crystal grain size; if the metal seamless pipe obtained by the step Z4 fails specification and performance requirements, repeating the steps Z3 and Z4 in sequence for at least once until the metal seamless pipe satisfies the specification and performance requirements.

Preferably, when a ratio of a diameter D to a wall thickness h of the metal seamless pipe with the reduced diameter obtained after the steps 1-7 is $D/h<10$, at least one of a step Z1 and a step Z2 is inserted after the step 7 to reduce the diameter and a wall thickness, and then a step Z3 and a step Z4 are inserted before performing the steps 8-14;

Z1) performing warm-drawing to reduce the diameter: synchronically performing electromagnetic induction heating and warm-drawing to the metal seamless pipe with the reduced diameter, which mainly reduces the diameter and secondarily reduces the wall thickness, thereby obtaining the metal seamless pipe whose diameter is reduced by the warm-drawing;

Z2) performing warm-expansion to reduce the wall thickness and increase the diameter: when a wall thickness reduction of the metal seamless pipe after the warm-drawing fails production requirements, synchronically performing the electromagnetic induction heating and the warm-expansion to the metal seamless pipe with the reduced diameter, which mainly reduces the wall thickness and secondarily reduces the diameter, thereby obtaining the metal seamless pipe whose diameter is changed by the warm-drawing;

After at least one of the steps Z1 and Z2 is performed, if the metal seamless pipe obtained by the cold-drawing or the cold-expansion fails diameter and wall thickness reduction requirements, then repeating at least one of the steps Z1 and Z2 for at least once until the metal seamless pipe satisfies the diameter and wall thickness reduction requirements, and then performing the steps Z3 and Z4;

Z3) performing the heat treatment: processing the metal seamless pipe with the reduced diameter with the heat treatment; and Z4) performing precise cold-rolling: after the heat treatment, processing the metal seamless pipe with small-deformation cold-rolling through a multi-roller cold-rolling technology, to obtain a higher pipe dimensional accuracy and a finer crystal grain size;

If the metal seamless pipe obtained by step Z4 fails specification and performance requirements, repeating the steps Z3 and Z4 in sequence at least once until the metal seamless pipe satisfies the specification and performance requirements.

Preferably, in step 1, the sized solid metal blank is transported into a heating furnace through a furnace bottom roller bed, and four sets of furnace flame nozzles are divided into an upper layer and a lower layer in the heating furnace; a heating temperature is determined according to metal properties of the solid metal blank; during heating, an error between an actual heating temperature and the set heating temperature is ±10° C.; the sized solid metal blank needs to be transformed into the hollow blank pipe; since cold metal has a large resistance and is difficult to deform, it needs to be heated; the solid metal blank can be grouped and transported into a furnace body by the furnace bottom roller bed; to ensure heating evenly, four sets of furnace flame nozzles are divided into an upper layer and a lower layer;

In step 2, the heated solid metal blank is drilled through large rolling angle drilling, to obtain the hollow blank pipe; during the large rolling angle drilling, an upper cylindrical roller and a lower cylindrical roller rotate oppositely to in-take the solid metal blank; under a pulling force of the upper cylindrical roller and the lower cylindrical roller, the solid metal blank contacts with a rotating head which drills a cavity in a center the solid metal blank to obtain the hollow blank pipe; a total deformative compression of the solid metal blank is 10%-25%, a tip compression of the rotating head is 3%-12%, and a roller taper angle is 12°-25°. However, during drilling, the solid metal blank is always spiraling forwards, so spiral joints produced in this process will be eliminated by the subsequent internal and external grinding of the hollow blank pipe. Compared with commonly used metal drilling, the large rolling angle drilling technology can effectively reduce a contact area with the metal by more than 40%; the rotating head starts to rotate before it comes into contact with the solid metal blank, which reduces shear stress between the rotating head and the internal wall of the pipe, thereby avoiding defects such as cracks and interlayers in the hole.

Preferably, in step 3, the external wall of the hollow blank pipe is ground by a grinding wheel head to eliminate oxide scales and spiral joints left on the external wall by drilling; the grinding wheel head is divided into a large-grain coarse grinding wheel head, a medium-grain emery cloth head, and a fine-grain grinding wheel head; the large-grain grinding wheel head is used to eliminate the spiral joints on the external wall of the hollow blank pipe, the medium-grain emery cloth head is used to grind metal burrs caused by the large-grain coarse grinding wheel head, and the fine-grain grinding wheel head is used to polish the external wall of the hollow blank pipe; a grinding thickness of the grinding wheel head is 0.1 mm-10 mm, a roundness error after grinding is 0-0.05 mm, a hole diameter deviation is ±0.01 mm, a surface finish satisfies a Ra0.2 standard; the external wall of the hollow blank pipe is ground back and forth;

In step 4, the internal wall of the hollow blank pipe is ground by a wire grinding head to eliminate oxide scales as well as deflection and interlayer problems left on the internal wall by drilling; a grinding thickness of the wire grinding head is 0.1 mm-5 mm, a steel wire diameter of the wire grinding head is ≤0.1 mm;

In step 5, the hollow blank pipe is soaked in an alkaline cleaning solution to clean the internal and external walls, thereby removing surface grinding head grits, metal burrs, and oil stains; the hollow blank pipe is overturned 3-5 times in the alkaline cleaning solution, a soaking time is 5-10 minutes, and a pH value of the alkaline cleaning solution is 8-10.

Preferably, in the step 6, an oblique straightening method is adopted, or a combined method comprising pressure straightening and oblique straightening is adopted; wherein for the hollow blank pipe with a diameter of less than 350 mm and a ratio of the diameter to a wall thickness of greater than 25, the oblique straightening method is used to eliminate deflection and flattening deformation of the hollow blank pipe; or for the hollow blank pipe with a diameter of greater than 350 mm and a ratio of the diameter to a wall thickness of less than 25, both the pressure straightening and the oblique straightening are used; the pressure straightening is used to eliminate bending deflection of the hollow blank pipe; the oblique straightening is used to eliminate the flattening deformation while eliminating a residual stress of the hollow blank pipe; a rotating indenter of the oblique straightening contacts with the hollow blank pipe in an obliquely rotating form, and a moving indenter of the pressure straightening contacts with the hollow blank pipe in a vertical form; after straightening, an external diameter roundness error of the hollow blank pipe is 0-0.1 mm, and a straightness is ≤0.3 mm/m; for the ground hollow blank pipe, due to a relatively large deformation caused by drilling and inconsistent metal deformation characteristics, a large amount of internal stress and uneven distribution are bound to occur. Therefore, bending and collapse will occur during cooling, and the internal residual stress will be relatively large; the present invention solves the above problems through straightening; for large-diameter and thick-walled pipes, due to relatively large deformation resistance, both the pressure straightening and the oblique straightening are applied; the pressure straightening can eliminate the bending deflection; however, the pressure straightening has a good straightening effect in straightness but is poor on roundness (the subsequent cold-rolling is performed with mandrels, which inevitably requires higher roundness), so the oblique straightening is used at the same time to flatting the hollow blank pipe in a straightening roller, in such a manner that a good straightening effect can be obtained while the residual stress can be sufficiently eliminated;

In step 7, the straightened hollow blank pipe is heated by a third induction heating device; an optimal warm-rolling temperature is determined according to an optimal hot working temperature of the metal seamless pipe, which is preferably 50%-70% of optimal hot working temperature of the metal seamless pipe, and an induction heating time is ≤30 S; and then a four-roller rolling mill is used for rolling; a rolling formation unit of the four-roller rolling mill is formed by four vertical rollers and a set of mandrels with tapered surfaces; a top roller and a bottom roller of the four rollers are working rollers, and two middle rollers of the four rollers are supporting rollers having continuous tapered section holes; the hollow blank pipe is placed between the two supporting rollers, and forms a closed deformation hole with the mandrels; the hollow blank pipe is plastically deformed in the deformation hole, and a deformation is no more than 50%; meanwhile, metal crystal grains of the hollow blank pipe are crushed, and a crystal grain size grade is 4-9; during rolling, the two working rollers translate horizontally and rotates oppositely, while the two supporting rollers are kept in contact with the working rollers to be driven; the four rollers coordinately push the hollow blank pipe to extend longitudinally; at an extreme position of the four-roller rolling mill, the mandrels rotate for advancing the hollow blank pipe; a rotation angle of the mandrels is 0°-75°, and a pipe advancing volume per each pass is 0 mm-10 mm; after the four-roller warm-rolling, a maximum deformation of the hollow blank pipe is up to 50%, a metal pipe crystal grain size grade is 5-7, a wall thickness tolerance is ≤7%, an external diameter roundness error is 0 mm-0.1 mm and ≤3%, a wall thickness unevenness is ≤5%, and a straightness is ≤0.2 mm/m; an induction heating temperature range of the third induction heating device is 0° C.-1600° C.; during the four-roller warm-rolling, an induction heating temperature is set according to a melting point of the hollow blank pipe; after straightening, the four-roller warm-rolling is carried out in order to obtain a composite pipe with higher precision, better performance and more complete specifications;

In step 8, the metal seamless pipe with the reduced diameter is soaked in an alkaline cleaning solution to remove surface oil stains; the metal seamless pipe is overturned 3-5 times in the alkaline cleaning solution, a soaking time is 5-10 minutes, and a pH value of the alkaline cleaning solution is 8-10.

Preferably, in the step Z1, the metal seamless pipe with the reduced diameter is heated by a first induction heating device; a heating temperature is controlled at 50%-70% of an optimal hot working temperature of the metal seamless pipe, and an induction heating time is ≤30 S; the metal seamless pipe is plastically deformed in a drawing die which mainly reduces the diameter and secondarily reduces a wall thickness, so as to process the metal seamless pipe with the warm-drawing; a taper angle of a necking core head die of the drawing die is 5°-25°, and a length of a core head sizing belt is 3%-50% of the diameter of the metal seamless pipe; a single-pass diameter expansion capacity is 0%-25% of the diameter of the metal seamless pipe, and a single-pass wall thickness reduction is −10%-+15% of the wall thickness of the metal seamless pipe; an induction heating temperature range of the first induction heating device is 0° C.-1600° C., and dynamically adjustment is used according to the melting point of the metal seamless pipe; for the difficult-to-deform metal pipe after the four-roller warm-rolling, in order to obtain extreme specifications, the diameter and the wall thickness need to be reduced by warm-drawing; however, the high-performance difficult-to-deform metal pipe has a poor metal plasticity and a high tensile stress during drawing, and is prone to fracture; therefore, induction heating is required to increase pipe temperature, so as to increase pipe plasticity and facilitate the slippage of internal crystal grains of the metal material;

In the step Z2, the metal seamless pipe after the warm-drawing is heated by a second induction heating device; a heating temperature is controlled at 50%-70% of the optimal hot working temperature of the metal seamless pipe, and an induction heating time is ≤30 S; the metal seamless pipe is plastically deformed in an expansion die which mainly reduces the wall thickness and secondarily reduces the diameter, so as to process the metal seamless pipe with the warm-expansion; a taper angle of a core die of the expansion die is 5°-25°, and a length of a core head sizing belt is 10 mm-300 mm; a single-pass diameter expansion capacity is 0%-20% of the diameter of the metal seamless pipe, and a single-pass wall thickness reduction is 0%-15% of the wall thickness of the metal seamless pipe; an induction heating temperature range of the second induction heating device is 0° C.-1600° C., and dynamically adjustment is used according to the melting point of the metal seamless pipe; for the metal composite pipe after warm-drawing to reduce the diameter, in order to obtain the extreme specifications, the wall thickness should be reduced while the diameter needs to be increased when the wall thickness reduction cannot meet the production requirements.

Preferably, step Z3 comprises quenching and tempering; wherein the metal seamless pipe with the reduced diameter is transported into a heating furnace through a furnace bottom roller bed, and four sets of furnace flame nozzles are divided into an upper layer and a lower layer in the heating furnace to ensure evenly heating; a heating temperature and a holding time are determined according to metal properties of the metal seamless pipe; after the heat treatment, a crystal grain size grade is 4-7, and residual stress is ≤50 MPa; during the heat treatment, an error between an actual heating temperature and the set heating temperature is ±10° C.;

for the metal seamless pipe after the four-roller warm-rolling, the warm-drawing, the warm-expansion, and the precise rolling, due to a large process deformation, a large amount of residual stress is generated, and a large number of crushed crystal grains are generated due to plastic deformation, which is easy to break the metal seamless pipe, especially those made of metal materials that are difficult to deform; therefore, the heat treatment must be performed to eliminate residual stress while allowing dynamic recrystallization of the metal crystal grains as well as eliminating harmful intercrystalline phases.

The step Z4 adopts a multi-roller cold-rolling mill; the multi-roller cold-rolling mill comprises multiple rollers each having a hole, and a set of rolling mandrels with tapered surfaces, wherein hole dimensions of the rollers of the same multi-roller cold-rolling mill are identical; after the warm-drawing, the warm expansion and the heat treatment, the metal seamless pipe is placed in the rollers, and forms a closed deformation hole with the rolling mandrels; the metal seamless pipe is plastically deformed in the closed deformation hole while the metal crystal grains of the metal seamless pipe are crushed; during rolling, the rollers translate horizontally while rotate oppositely, thereby pushing the metal seamless pipe to extend in a longitudinal direction; at extreme positions of the rollers, the rolling mandrels rotate for advancing the metal seamless pipe; a rotation range of the rolling mandrels is 0°-60°, and a pipe advancing volume per each pass is 0-3 mm; after the precise cold-rolling, a maximum deformation of the metal seamless pipe is 20%, a metal pipe crystal grain size grade is 7-9, a wall thickness tolerance is ≤5%, an external diameter roundness error is 0 mm-0.05 mm, a wall thickness unevenness is ≤5%, and a straightness is ≤0.15 mm/m; a quantity of the rollers in the multi-roller cold-rolling mill is three, four, five or six.

For the metal seamless pipe after the heat treatment, to obtain higher precision, better performance, and more outstanding extreme specifications, the multi-roller (three-roller, four-roller, five-roller, or six-roller) cold-rolling is carried out to obtain the metal seamless pipe with finer crystal grain size, more comprehensive extreme specifications, better surface quality, and better metal pipe toughness.

Preferably, in step 9, the degreased metal seamless pipe is transported into a bright cleaning furnace through a furnace bottom conveyor belt, wherein four sets of furnace nozzles are divided into an upper layer and a lower layer in the bright cleaning furnace, to ensure uniform heating of the metal seamless pipe; the bright cleaning furnace is connected to a hydrogen generating device which generates hydrogen, and the hydrogen undergoes combustion reaction with oxygen to provide heat energy for the bright cleaning furnace;

For the metal seamless pipe after the four-roller warm-rolling, the warm-drawing, the warm-expansion, and the precise rolling, due to a large process deformation, the metal seamless pipe is very easy to be oxidized during the rolling and needs to be brightened.

In step 10, the external wall of the brightened metal seamless pipe is ground with a fine-grain grinding wheel head to eliminate surface quality problems of the metal seamless pipe caused by surface oxide films and pass processes, a grinding thickness is 0.1 mm-1 mm, a roundness error after grinding is 0.01 mm-0.02 mm, a hole diameter deviation is ±0.01 mm, and a surface finish satisfies a Ra0.2 standard;

In step 11, the internal and external walls of the metal seamless pipe are cleaned with a negative pressure cleaning device, thereby removing surface grinding head grit and the metal burrs.

Preferably, in step 12, the high-performance difficult-to-deform metal seamless pipe is processed with surface ultrasonic detection by using an eddy current flaw detection device, to obtain crack defect information of the metal seamless pipe after large deformation for discarding the unqualified high-performance difficult-to-deform metal seamless pipe;

In step 13, the qualified high-performance difficult-to-deform metal seamless pipe is sampled through physical testing and chemical testing for analyzing mechanical properties, grain sizes, and corrosion resistance, and evaluating metal pipe performance; steps 7-13 are repeated to the unqualified high-performance difficult-to-deform metal seamless pipe until the qualified high-performance difficult-to-deform metal seamless pipe is obtained.

Compared with the prior art, the present invention has the following beneficial effects:

(1) Continuous production capacity of the difficult-to-deform metal seamless pipe can be greatly improved, which greatly improves production efficiency and effectively reduces production costs.

(2) Product requirements of different hard-to-deform metal materials and different product specifications can be satisfied, to flexibly prepare metal pipe products with different material characteristics.

(3) Key indicators such as product dimensional accuracy, surface quality, material properties, and crystal grain size can be collaboratively controlled, thereby obtaining high-performance and high-precision seamless pipes.

Figure 1:
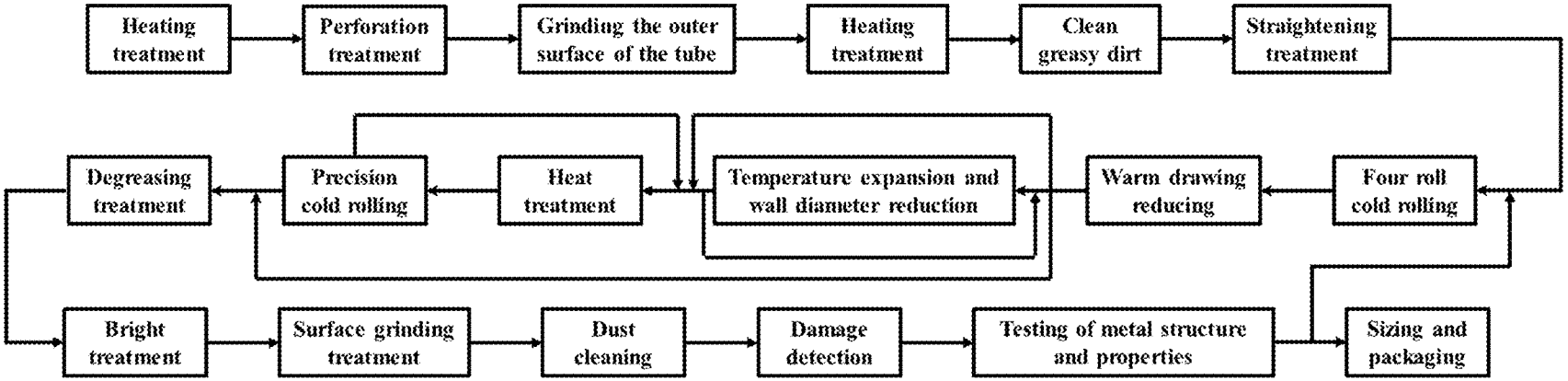
FIG. 1 is a flow chart of the present invention.

Element reference: 1—heating furnace, 11—furnace bottom roller bed, 12—furnace flame nozzle, 101—solid metal blank, 21—upper cylindrical roller, 22—lower cylindrical roller, 23—rotating head, 102—hollow blank pipe, 3—grinding wheel head, 4—wire grinding head, 61—moving indenter, 62—rotating indenter, 71—mandrel, 72—working roller, 73—supporting roller, 74—third induction heating device, 103—metal seamless pipe, 81—first induction heating device, 82—drawing die, 83—second induction heating device, 84—expansion die, 85—roller, 86—rolling mandrel, 91—furnace bottom conveyor belt, 92—furnace nozzle, 93—hydrogen generator, 111—negative pressure cleaning device, 121—eddy current flaw detection device.

DETAILED DESCRIPTION OF THE PREFERRED EMBODIMENT

Referring to the drawings and embodiments, the technical solutions of the present invention will be further described below. To those skilled in the art, it is clear that the embodiments are exemplary only and should not be regarded as specific limitations to the present invention.

Embodiment 1

Figure 2:
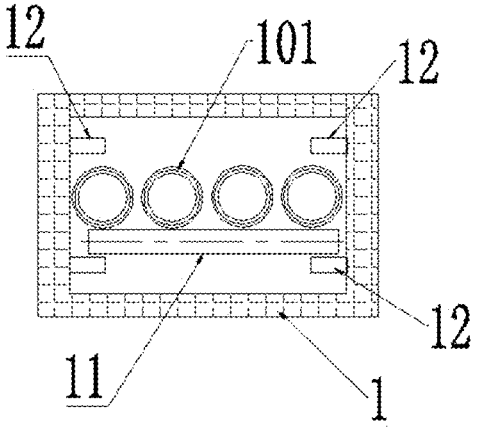
FIG. 2 is a sketch view of a heat treatment according to step 1 of the present invention.
Figure 3:
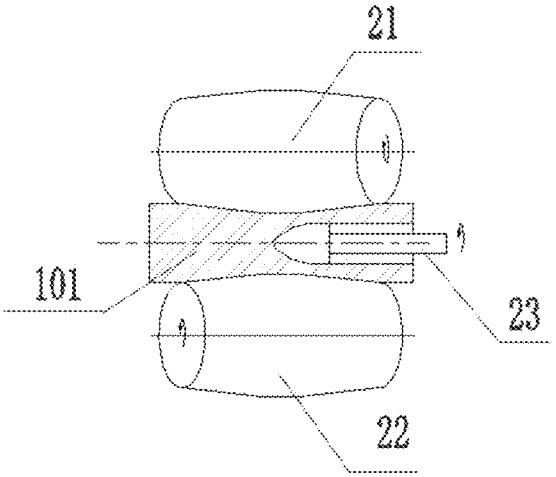
FIG. 3 is a sketch view of large rolling angle drilling according to step 2 of the present invention.
Figure 4:
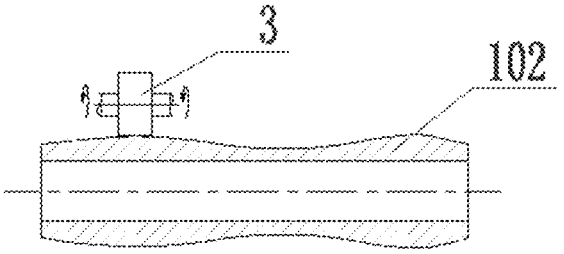
FIG. 4 is a sketch view of externally grinding according to step 3 of the present invention.
Figure 5:
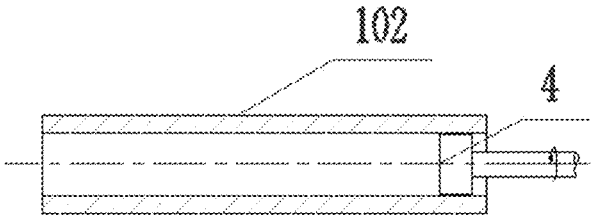
FIG. 5 is a sketch view of internally grinding according to step 4 of the present invention.
Figure 6:
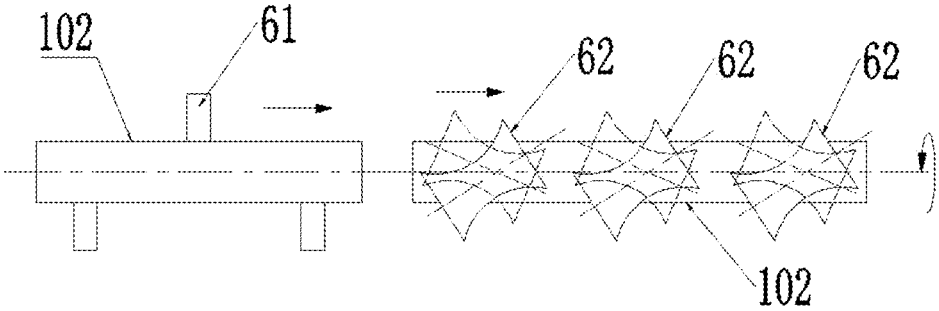
FIG. 6 is a sketch view of straightening according to step 6 of the present invention.
Figure 7:
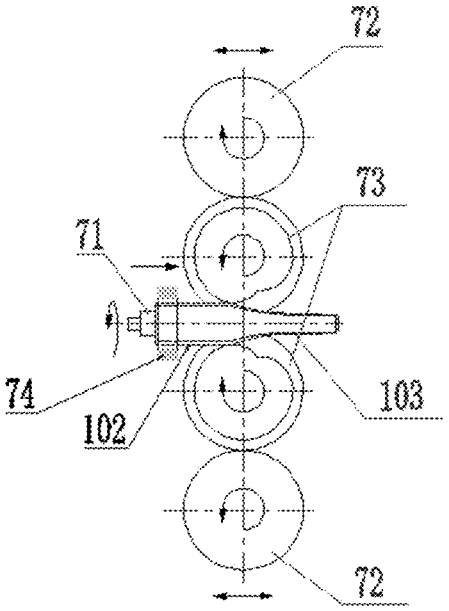
FIG. 7 is a sketch view of four-roller warm-rolling according to step 7 of the present invention.
Figure 13:
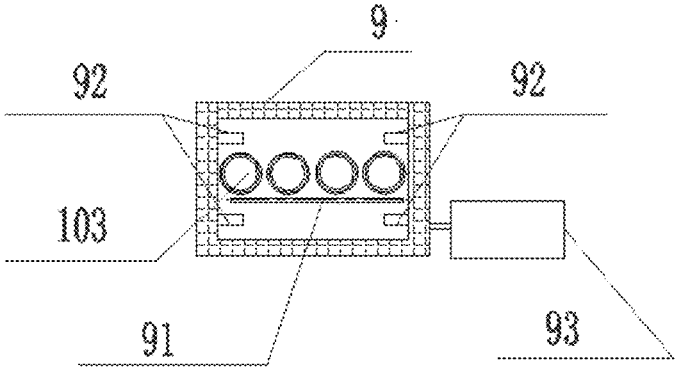
FIG. 13 is a sketch view of brightening according to step 9 of the present invention.
Figure 14:
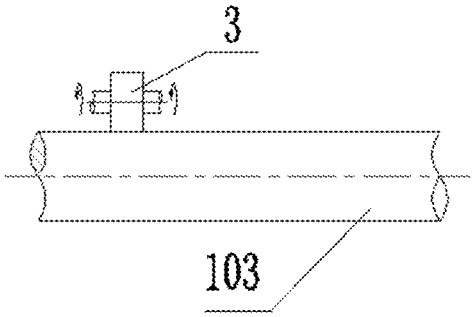
FIG. 14 is a sketch view of surface grinding according to step 10 of the present invention.
Figure 15:
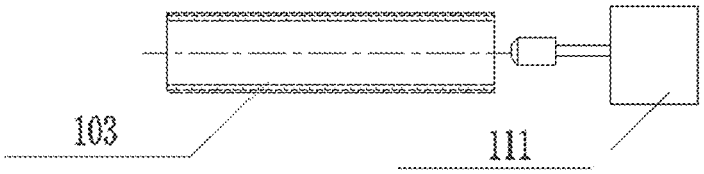
FIG. 15 is a sketch view of cleaning dust according to step 11 of the present invention.
Figure 16:
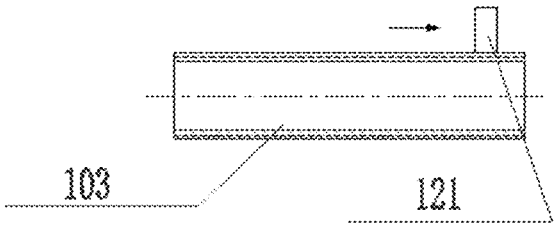
FIG. 16 is a sketch view of detecting flaws according to step 12 of the present invention.

Referring to FIGS. 1-7 and 13-16, a method for preparing a high-performance difficult-to-deform metal precision seamless pipe is provided, comprising steps of:

1) performing a heat treatment: heating a solid metal blank 101 after sizing to reduce a metal resistance; wherein the sized solid metal blank 101 is transported into a heating furnace 1 through a furnace bottom roller bed 11, and four sets of furnace flame nozzles 12 are divided into an upper layer and a lower layer in the heating furnace 1; a heating temperature is determined according to metal properties of the solid metal blank 101; during heating, an error between an actual heating temperature and the set heating temperature is ±10° C.;

2) Drilling: drilling a hole on the heated solid metal blank 101 through large rolling angle drilling to obtain a hollow blank pipe 102; wherein during the large rolling angle drilling, an upper cylindrical roller 21 and a lower cylindrical roller 22 rotate oppositely to in-take the solid metal blank 101; under a pulling force of the upper cylindrical roller 21 and the lower cylindrical roller 22, the solid metal blank 101 contacts with a rotating head 23 which drills a cavity in a center the solid metal blank 101 to obtain the hollow blank pipe 102; a total deformative compression of the solid metal blank 101 is 10%-25%, a tip compression of the rotating head 23 is 3%-12%, and a roller taper angle is 12°-25°;

3) Externally grinding: grinding an external wall of the hollow blank pipe 102; wherein the external wall of the hollow blank pipe 102 is ground by a grinding wheel head 3 to eliminate oxide scales and spiral joints left on the external wall by drilling; the grinding wheel head 3 is divided into a large-grain coarse grinding wheel head, a medium-grain emery cloth head, and a fine-grain grinding wheel head; the large-grain grinding wheel head is used to eliminate the spiral joints on the external wall of the hollow blank pipe 102, the medium-grain emery cloth head is used to grind metal burrs caused by the large-grain coarse grinding wheel head, and the fine-grain grinding wheel head is used to polish the external wall of the hollow blank pipe 102; a grinding thickness of the grinding wheel head 3 is 0.1 mm-10 mm, a roundness error after grinding is 0-0.05 mm, a hole diameter deviation is ±0.01 mm, a surface finish satisfies a Ra0.2 standard;

4) Internally grinding: grinding an internal wall of the hollow blank pipe 102; wherein the internal wall of the hollow blank pipe 102 is ground by a wire grinding head 4 to eliminate oxide scales as well as deflection and interlayer problems left on the internal wall by drilling; a grinding thickness of the wire grinding head 4 is 0.1 mm-5 mm, a steel wire diameter of the wire grinding head 4 is ≤0.1 mm;

5) Cleaning oil stains: cleaning the internal wall and the external wall of the ground hollow blank pipe 102; wherein the hollow blank pipe 102 is soaked in an alkaline cleaning solution to clean the internal and external walls, thereby removing surface grinding head grits, metal burrs, and oil stains; the hollow blank pipe 102 is overturned 3-5 times in the alkaline cleaning solution, a soaking time is 5-10 minutes, and a pH value of the alkaline cleaning solution is 8-10;

6) Straightening: straightening the cleaned hollow blank pipe 102 to eliminate bending and collapse of the hollow blank pipe 102 due to uneven metal strain distribution caused by drilling and grinding; wherein an oblique straightening method is adopted, or a combined method comprising pressure straightening and oblique straightening is adopted; wherein for the hollow blank pipe 102 with a diameter of less than 350 mm and a ratio of the diameter to a wall thickness of greater than 25, the oblique straightening method is used to eliminate deflection and flattening deformation of the hollow blank pipe 102; or for the hollow blank pipe 102 with a diameter of greater than 350 mm and a ratio of the diameter to a wall thickness of less than 25, both the pressure straightening and the oblique straightening are used; the pressure straightening is used to eliminate bending deflection of the hollow blank pipe 102; the oblique straightening is used to eliminate the flattening deformation while eliminating a residual stress of the hollow blank pipe 102; a rotating indenter 62 of the oblique straightening contacts with the hollow blank pipe 102 in an obliquely rotating form, and a moving indenter 61 of the pressure straightening contacts with the hollow blank pipe 102 in a vertical form; after straightening, an external diameter roundness error of the hollow blank pipe 102 is 0-0.1 mm, and a straightness is ≤0.3 mm/m;

7) Performing four-roller warm-rolling: processing the straightened hollow blank pipe 102 with the four-roller warm-rolling to perform large-deformation isothermal-rolling, thereby obtaining a metal seamless pipe 103 with a reduced diameter; wherein the straightened hollow blank pipe 102 is heated by a third induction heating device 74; an optimal warm-rolling temperature is 50%-70% of an optimal hot working temperature of the metal seamless pipe 103; and then a four-roller rolling mill is used for rolling; a rolling formation unit of the four-roller rolling mill is formed by four vertical rollers and a set of mandrels 71 with tapered surfaces; a top roller and a bottom roller of the four rollers are working rollers 72, and two middle rollers of the four rollers are supporting rollers 73 having continuous tapered section holes; the hollow blank pipe 102 is placed between the two supporting rollers 73, and forms a closed deformation hole with the mandrels 71; the hollow blank pipe 102 is plastically deformed in the deformation hole, and a deformation is no more than 50%; meanwhile, metal crystal grains of the hollow blank pipe 102 are crushed, and a crystal grain size grade is 4-9; during rolling, the two working rollers 72 translate horizontally and rotates oppositely, while the two supporting rollers 73 are kept in contact with the working rollers 72 to be driven; the four rollers coordinately push the hollow blank pipe 102 to extend longitudinally; at an extreme position of the four-roller rolling mill, the mandrels 71 rotate for advancing the hollow blank pipe 102; a rotation angle of the mandrels 71 is 0°-75°, and a pipe advancing volume per each pass is 0 mm-10 mm; after the four-roller warm-rolling, a maximum deformation of the hollow blank pipe 102 is up to 50%, a metal pipe crystal grain size grade is 5-7, a wall thickness tolerance is ≤7%, an external diameter roundness error is 0 mm-0.1 mm, a wall thickness unevenness is ≤5%, and a straightness is ≤0.2 mm/m; an induction heating temperature range of the third induction heating device 74 is 0° C.-1600° C.; during the four-roller warm-rolling, an induction heating temperature is set according to a melting point of the hollow blank pipe 102;

8) Degreasing: wherein the metal seamless pipe 103 with the reduced diameter is soaked in an alkaline cleaning solution to remove surface oil stains; the metal seamless pipe 103 is overturned 3-5 times in the alkaline cleaning solution, a soaking time is 5-10 minutes, and a pH value of the alkaline cleaning solution is 8-10;

9) Brightening: brightening the degreased metal seamless pipe 103; wherein the degreased metal seamless pipe 103 is transported into a bright cleaning furnace 9 through a furnace bottom conveyor belt 91, wherein four sets of furnace nozzles 92 are divided into an upper layer and a lower layer in the bright cleaning furnace 9, to ensure uniform heating of the metal seamless pipe 103; the bright cleaning furnace 9 is connected to a hydrogen generating device 93 which generates hydrogen, and the hydrogen undergoes combustion reaction with oxygen to provide heat energy for the bright cleaning furnace 9;

10) Performing surface grinding: processing the brightened metal seamless pipe 103 with the surface grinding; wherein the external wall of the brightened metal seamless pipe 103 is ground with a fine-grain grinding wheel head 3 to eliminate surface quality problems of the metal seamless pipe 103 caused by surface oxide films and pass processes, a grinding thickness is 0.1 mm-1 mm, a roundness error after grinding is 0.01 mm-0.02 mm, a hole diameter deviation is ±0.01 mm, and a surface finish satisfies a Ra0.2 standard;

11) Cleaning dust: cleaning the ground metal seamless pipe 103 to obtain the high-performance difficult-to-deform metal seamless pipe 103; wherein the internal and external walls of the metal seamless pipe 103 are cleaned with a negative pressure cleaning device 111, thereby removing surface grinding head grit and the metal burrs;

12) Detecting flaws: wherein the high-performance difficult-to-deform metal seamless pipe 103 is processed with surface ultrasonic detection by using an eddy current flaw detection device 121, to obtain crack defect information of the metal seamless pipe 103 after large deformation for discarding the unqualified high-performance difficult-to-deform metal seamless pipe 103;

13) Testing metal structure performance: sampling the qualified high-performance difficult-to-deform metal seamless pipe 103 and testing the metal structure performance; wherein the qualified high-performance difficult-to-deform metal seamless pipe 103 is sampled through physical testing and chemical testing for analyzing mechanical properties, grain sizes, and corrosion resistance, and evaluating metal pipe performance; the steps 7-13 are repeated to the unqualified high-performance difficult-to-deform metal seamless pipe 103 until the qualified high-performance difficult-to-deform metal seamless pipe 103 is obtained; and 14) Sizing and packaging: packaging the qualified high-performance difficult-to-deform metal seamless pipe 103.

The method of embodiment 1 is suitable for preparing high-performance difficult-to-deform metal precision seamless pipes with a diameter of D15 mm-D800 mm, a wall thickness of 3 mm-30 mm, a crystal grain size grade of 5-7, a wall thickness tolerance of ≤7%, an external diameter roundness error of 0 mm-0.1 mm, a wall thickness unevenness of ≤5%, and straightness of ≤0.2 mm/m.

Embodiment 2

Figure 10:
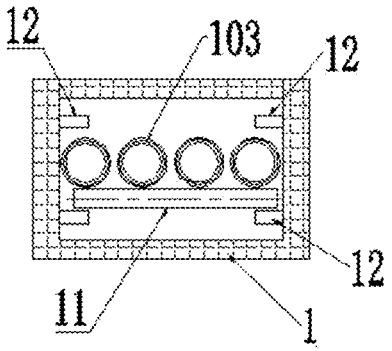
FIG. 10 is a sketch view of a heat treatment according to a step Z3 of the present invention.
Figure 11:
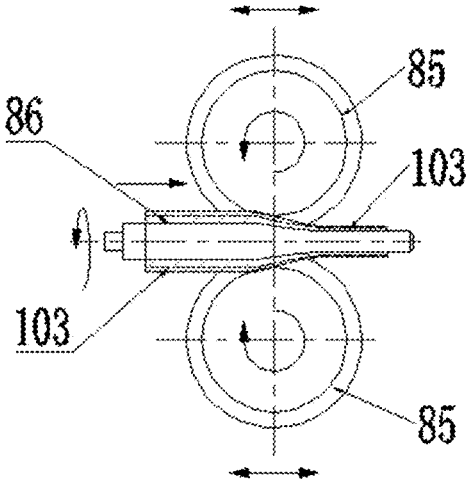
FIG. 11 is a sketch view of multi-roller cold-rolling according to a step Z4 of the present invention.
Figure 12:
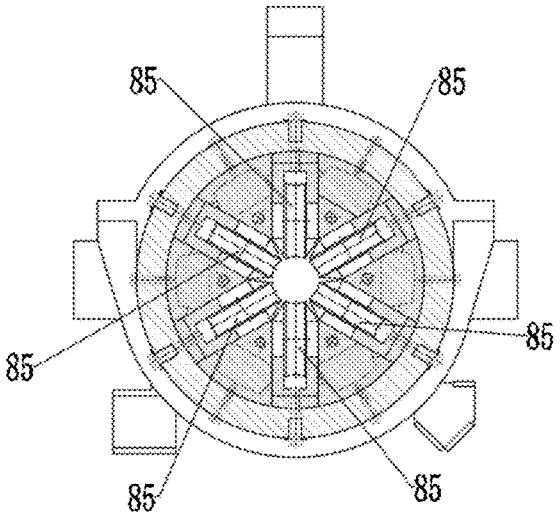
FIG. 12 is a sketch view of six-roller cold-rolling according to the step Z4 of the present invention.

Referring to FIGS. 1-7 and 10-16, when a ratio of a diameter D to a wall thickness h of the metal seamless pipe 103, which is obtained after step 7 in embodiment 1, is 10≤D/h≤15, steps Z3 and Z4 are inserted after the step 7 before performing the steps 8-14. According to embodiment 2, a method for preparing a high-performance difficult-to-deform metal precision seamless pipe is provided, comprising steps of:

Steps 1-7 are the same as those in embodiment 1.

Z3) Performing the heat treatment: processing the metal seamless pipe 103 with the reduced diameter with the heat treatment, which comprises quenching and tempering; wherein the metal seamless pipe 103 with the reduced diameter is transported into a heating furnace 1 through a furnace bottom roller bed 11, and four sets of furnace flame nozzles 12 are divided into an upper layer and a lower layer in the heating furnace 1; a heating temperature and a holding time are determined according to metal properties of the metal seamless pipe 103; after the heat treatment, a crystal grain size grade is 4-7, and residual stress is ≤50 MPa; during the heat treatment, an error between an actual heating temperature and the set heating temperature is ±10° C.; and Z4) Performing precise cold-rolling: after the heat treatment, processing the metal seamless pipe 103 with small-deformation cold-rolling by using a multi-roller cold-rolling technology, to obtain a higher pipe dimensional accuracy and a finer crystal grain size; if the metal seamless pipe 103 obtained by the step Z4 fails specification and performance requirements, repeating the steps Z3 and Z4 in sequence for at least once until the metal seamless pipe 103 satisfies the specification and performance requirements;

The step Z4 adopts a six-roller cold-rolling mill; the six-roller cold-rolling mill comprises six rollers 85 evenly distributed in a circumferential direction and each having a hole, and a set of rolling mandrels 86 with tapered surfaces, wherein hole dimensions of the rollers are identical; after the warm-drawing, the warm expansion and the heat treatment, the metal seamless pipe 103 is placed in the rollers 85, and forms a closed deformation hole with the rolling mandrels 86; the metal seamless pipe 103 is plastically deformed in the closed deformation hole while the metal crystal grains of the metal seamless pipe 103 are crushed; during rolling, the rollers 85 translate horizontally while rotate oppositely, thereby pushing the metal seamless pipe 103 to extend in a longitudinal direction; at extreme positions of the rollers 16, the rolling mandrels 86 rotate for advancing the metal seamless pipe 103; a rotation range of the rolling mandrels 86 is 0°-60°, and a pipe advancing volume per each pass is 0-3 mm;

after the precise cold-rolling, a maximum deformation of the metal seamless pipe 103 is 20%, a metal pipe crystal grain size grade is 7-9, a wall thickness tolerance is ≤5%, an external diameter roundness error is 0 mm-0.05 mm, a wall thickness unevenness is ≤5%, and a straightness is <0.15 mm/m; according to the embodiment 2, a quantity of the rollers 85 in the multi-roller cold-rolling mill is three, four or five.

Steps 8-14 are the same as those in embodiment 1.

The method of embodiment 2 is suitable for preparing high-performance difficult-to-deform metal precision seamless pipes with a diameter of Φ3 mm-Φ800 mm, a wall thickness of 1 mm-20 mm, a crystal grain size grade of 7-9, a wall thickness tolerance of ≤5%, an external diameter roundness error of 0 mm-0.05 mm, a wall thickness unevenness of ≤5%, and straightness of ≤0.15 mm/m.

Embodiment 3

Figure 8:
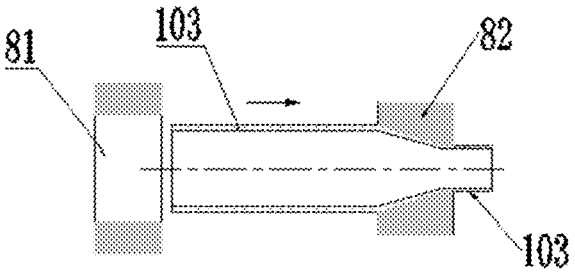
FIG. 8 is a sketch view of warm-drawing to reduce a diameter according to a step Z1 of the present invention.

Referring to FIGS. 1-8 and 10-16, when a ratio of a diameter D to a wall thickness h of the metal seamless pipe 103, which is obtained after step 7 in embodiment 2, is D/h<10, a step Z1 is inserted before performing the step Z3 to mainly reduce the diameter and secondarily reduce the wall thickness. According to embodiment 3, a method for preparing a high-performance difficult-to-deform metal precision seamless pipe is provided, comprising steps of:

Steps 1-7 are the same as those in embodiment 2.

Z1) Performing warm-drawing to reduce the diameter: wherein the metal seamless pipe 103 with the reduced diameter is heated by a first induction heating device 81; a heating temperature is controlled at 50%-70% of an optimal hot working temperature of the metal seamless pipe 103, and an induction heating time is ≤30 S; the metal seamless pipe 103 is plastically deformed in a drawing die 82 which mainly reduces the diameter and secondarily reduces a wall thickness, so as to process the metal seamless pipe 103 with the warm-drawing; a taper angle of a necking core head die of the drawing die 82 is 5°-25°, and a length of a core head sizing belt is 3%-50% of the diameter of the metal seamless pipe 103; a single-pass diameter expansion capacity is 0%-25% of the diameter of the metal seamless pipe 103, and a single-pass wall thickness reduction is −10%-+15% of the wall thickness of the metal seamless pipe 103; an induction heating temperature range of the first induction heating device 81 is 0° C.-1600° C.;

If the metal seamless pipe 103 obtained by the cold-drawing fails diameter and wall thickness reduction requirements, then repeating the step Z1 at least once until the metal seamless pipe 103 satisfies the diameter and wall thickness reduction requirements, and then performing the steps Z3 and Z4.

Steps Z3, Z4, and 8-14 are the same as those in embodiment 2.

The method of embodiment 3 is suitable for preparing high-performance difficult-to-deform metal precision seamless pipes with a diameter of Φ3 mm-Φ600 mm, a wall thickness of 1 mm-20 mm, a crystal grain size grade of 7-9, a wall thickness tolerance of ≤5%, an external diameter roundness error of 0 mm-0.05 mm, a wall thickness unevenness of ≤5%, and straightness of ≤0.15 mm/m.

Embodiment 4

Figure 9:
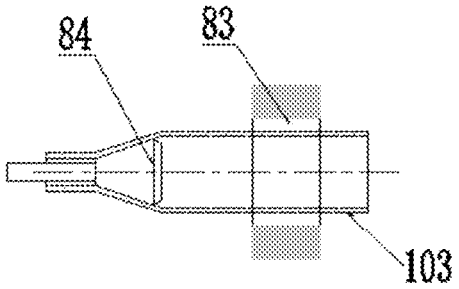
FIG. 9 is a sketch view of warm-expansion to reduce a wall thickness and increase the diameter according to a step Z2 of the present invention.

Referring to FIGS. 1-7 and 9-16, when a ratio of a diameter D to a wall thickness h of the metal seamless pipe 103, which is obtained after step 7 in embodiment 2, is D/h<10, a step Z2 is inserted before performing the step Z3 to mainly reduce the wall thickness and secondarily reduce the diameter. According to embodiment 4, a method for preparing a high-performance difficult-to-deform metal precision seamless pipe is provided, comprising steps of:

Steps 1-7 are the same as those in embodiment 2.

Z2) Performing warm-expansion to reduce the wall thickness and increase the diameter: wherein when a wall thickness reduction of the metal seamless pipe 103 after the warm-drawing fails production requirements, the metal seamless pipe 103 after the warm-drawing is heated by a second induction heating device 83; a heating temperature is controlled at 50%-70% of the optimal hot working temperature of the metal seamless pipe 103, and an induction heating time is ≤30 S; the metal seamless pipe 103 is plastically deformed in an expansion die 84 which mainly reduces the wall thickness and secondarily reduces the diameter, so as to process the metal seamless pipe 103 with the warm-expansion; a taper angle of a core die of the expansion die 84 is 5°-25°, and a length of a core head sizing belt is 10 mm-300 mm; a single-pass diameter expansion capacity is 0%-20% of the diameter of the metal seamless pipe 103, and a single-pass wall thickness reduction is 0%-15% of the wall thickness of the metal seamless pipe 103; an induction heating temperature range of the second induction heating device 83 is 0° C.-1600° C.;

If the metal seamless pipe 103 obtained by the cold-expansion fails diameter and wall thickness reduction requirements, then repeating the step Z2 at least once until the metal seamless pipe 103 satisfies the diameter and wall thickness reduction requirements, and then performing the steps Z3 and Z4.

Steps Z3, Z4, and 8-14 are the same as those in embodiment 2.

The method of embodiment 4 is suitable for preparing high-performance difficult-to-deform metal precision seamless pipes with a diameter of D15 mm-D800 mm, a wall thickness of 1 mm-20 mm, a crystal grain size grade of 7-9, a wall thickness tolerance of ≤5%, an external diameter roundness error of 0 mm-0.05 mm, a wall thickness unevenness of ≤5%, and straightness of ≤0.15 mm/m.

Embodiment 5

Referring to FIGS. 1-16, when a ratio of a diameter D to a wall thickness h of the metal seamless pipe 103, which is obtained after step 7 in embodiment 2, is D/h<10, a step Z1 and a step Z2 are inserted before performing the step Z3 to reduce the diameter and the wall thickness. According to embodiment 5, a method for preparing a high-performance difficult-to-deform metal precision seamless pipe is provided, comprising steps of:

Steps 1-7 are the same as those in embodiment 2.

Z1) Performing warm-drawing to reduce the diameter: wherein the metal seamless pipe 103 with the reduced diameter is heated by a first induction heating device 81; a heating temperature is controlled at 50%-70% of an optimal hot working temperature of the metal seamless pipe 103, and an induction heating time is ≤30 S; the metal seamless pipe 103 is plastically deformed in a drawing die 82 which mainly reduces the diameter and secondarily reduces a wall thickness, so as to process the metal seamless pipe 103 with the warm-drawing; a taper angle of a necking core head die of the drawing die 82 is 5°-25°, and a length of a core head sizing belt is 3%-50% of the diameter of the metal seamless pipe 103; a single-pass diameter expansion capacity is 0%-25% of the diameter of the metal seamless pipe 103, and a single-pass wall thickness reduction is −10%-+15% of the wall thickness of the metal seamless pipe 103; an induction heating temperature range of the first induction heating device 81 is 0° C.-1600° C.; and Z2) Performing warm-expansion to reduce the wall thickness and increase the diameter: wherein when a wall thickness reduction of the metal seamless pipe 103 after the warm-drawing fails production requirements, the metal seamless pipe 103 after the warm-drawing is heated by a second induction heating device 83; a heating temperature is controlled at 50%-70% of a melting point of the metal seamless pipe 103, and an induction heating time is ≤30 S; the metal seamless pipe 103 is plastically deformed in an expansion die 84 which mainly reduces the wall thickness and secondarily reduces the diameter, so as to process the metal seamless pipe 103 with the warm-expansion; a taper angle of a core die of the expansion die 84 is 5°-25°, and a length of a core head sizing belt is 10 mm-300 mm; a single-pass diameter expansion capacity is 0%-20% of the diameter of the metal seamless pipe 103, and a single-pass wall thickness reduction is 0%-15% of the wall thickness of the metal seamless pipe 103; an induction heating temperature range of the second induction heating device 83 is 0° C.-1600° C.;

If the metal seamless pipe 103 obtained by the cold-drawing and the cold-expansion fails diameter and wall thickness reduction requirements, then repeating the steps Z1 and Z2 in sequence at least once until the metal seamless pipe 103 satisfies the diameter and wall thickness reduction requirements, and then performing the steps Z3 and Z4; if the metal seamless pipe 103 obtained by the step Z4 fails specification and performance requirements, repeating the steps Z3 and Z4 in sequence for at least once until the metal seamless pipe 103 satisfies the specification and performance requirements.

Steps Z3, Z4, and 8-14 are the same as those in embodiment 2.

The method of embodiment 5 is suitable for preparing high-performance difficult-to-deform metal precision seamless pipes with a diameter of Φ3 mm-Φ600 mm, a wall thickness of 0.5 mm-10 mm, a crystal grain size grade of 7-9, a wall thickness tolerance of ≤5%, an external diameter roundness error of 0 mm-0.05 mm, a wall thickness unevenness of ≤5%, and straightness of ≤0.15 mm/m.

According to embodiments 1-5, the optimal warm-rolling temperatures can be selected with reference to Table 1 according to the materials of the high-performance difficult-to-deform metal precision seamless pipe. During the large rolling angle drilling, the four-roller warm-rolling, the warm-drawing, the warm-expansion, and the precise cold-rolling, production parameters are determined within the above ranges according to the materials and the specification requirements (diameter, wall thickness, crystal grain size, and error) of the high-performance difficult-to-deform metal precision seamless pipe.

TABLE 1

Optimal warm-rolling temperatures of difficult-to-deform metals

| | Material | | | | |
|---|---|---|---|---|---|
| Temperature | Stainless steel | Copper alloy | Aluminum alloy | Titanium alloy | Magnesium alloy |
| Optimal warm-rolling temperature | 650-720° C. | 330-390° C. | 350-420° C. | 600-650° C. | 280-320° C. |

Table 1 only lists several commonly used metal materials. The method for preparing the high-performance difficult-to-deform metal precision seamless pipe of the present invention is not limited to the materials listed in the table.

What is claimed is:

1. A method for preparing a high-performance difficult-to-deform metal precision seamless pipe, comprising steps of:

1) performing a first heat treatment: heating a solid metal blank (101) after sizing to reduce a metal resistance; wherein the sized solid metal blank (101) is transported into a heating furnace (1) through a furnace bottom roller bed (11), and four sets of furnace flame nozzles (12) are divided into an upper layer and a lower layer in the heating furnace (1); a heating temperature is determined according to metal properties of the solid metal blank (101); during heating, an error between an actual heating temperature and the heating temperature determined according to the metal properties of the solid metal blank (101) is ±10° C.;

2) drilling: drilling a hole on the heated solid metal blank (101) to obtain a hollow blank pipe (102); wherein the heated solid metal blank (101) is drilled through large rolling angle drilling, to obtain the hollow blank pipe (102); during the large rolling angle drilling, an upper cylindrical roller (21) and a lower cylindrical roller (22) rotate oppositely to in-take the solid metal blank (101); under a pulling force of the upper cylindrical roller (21) and the lower cylindrical roller (22), the solid metal blank (101) contacts with a rotating head (23) which drills a cavity in a center of the solid metal blank (101) to obtain the hollow blank pipe (102); a total deformative compression of the solid metal blank (101) is 10%-25%, a tip compression of the rotating head (23) is 3%-12%, and a roller taper angle is 12°-25°;

3) externally grinding: grinding an external wall of the hollow blank pipe (102);

4) internally grinding: grinding an internal wall of the hollow blank pipe (102);

5) cleaning oil stains: cleaning the internal wall and the external wall of the ground hollow blank pipe (102);

6) straightening: straightening the cleaned hollow blank pipe (102) to eliminate bending and collapse of the hollow blank pipe (102) due to uneven metal strain distribution caused by drilling and grinding;

7) performing four-roller warm-rolling: processing the straightened hollow blank pipe (102) with the four-roller warm-rolling to perform large-deformation isothermal-rolling, thereby obtaining a metal seamless pipe (103) with a reduced diameter;

8) degreasing: degreasing the metal seamless pipe (103) with the reduced diameter;

9) brightening: brightening the degreased metal seamless pipe (103);

10) performing surface grinding: processing the brightened metal seamless pipe (103) with the surface grinding;

11) cleaning dust: cleaning the ground metal seamless pipe (103) to obtain the high-performance difficult-to-deform metal seamless pipe (103);

12) detecting flaws: processing the high-performance difficult-to-deform metal seamless pipe (103) with ultrasonic flaw detection and discarding unqualified high-performance difficult-to-deform metal seamless pipe (103);

13) testing metal structure performance: sampling the qualified high-performance difficult-to-deform metal seamless pipe (103) and testing the metal structure performance; and repeating the steps 7-13 to the unqualified high-performance difficult-to-deform metal seamless pipe (103) until the qualified high-performance difficult-to-deform metal seamless pipe (103) is obtained; and 14) sizing and packaging: packaging the qualified high-performance difficult-to-deform metal seamless pipe (103).

2. The method, as recited in claim 1, wherein when a ratio of a diameter D to a wall thickness h of the metal seamless pipe (103) with the reduced diameter obtained after the steps 1-7 is 10≤D/h≤15, steps Z3 and Z4 are inserted after the step 7 before performing the steps 8-14;

Z3) performing a second heat treatment: processing the metal seamless pipe (103) with the reduced diameter with the second heat treatment; and Z4) performing precise cold-rolling: after the second heat treatment, processing the metal seamless pipe (103) with small-deformation cold-rolling by using a multi-roller cold-rolling technology; if the metal seamless pipe (103) obtained by the step Z4 fails specification and performance requirements, repeating the steps Z3 and Z4 in sequence for at least once until the metal seamless pipe (103) satisfies the specification and performance requirements.

3. The method, as recited in claim 2, wherein the step Z3 comprises quenching and tempering; wherein the metal seamless pipe (103) with the reduced diameter is transported into a heating furnace (1) through a furnace bottom roller bed (11), and four sets of furnace flame nozzles (12) are divided into an upper layer and a lower layer in the heating furnace (1); a heating temperature and a holding time are determined according to metal properties of the metal seamless pipe (103); after the second heat treatment, a crystal grain size grade is 4-7, and residual stress is ≤50 MPa; during the second heat treatment, an error between an actual heating temperature and the heating temperature determined according to the metal properties of the metal seamless pipe (103) is ±10° C.;

the step Z4 adopts a multi-roller cold-rolling mill; the multi-roller cold-rolling mill comprises multiple rollers (85) each having a hole, and a set of rolling mandrels (86) with tapered surfaces; after the warm-drawing, the warm-expansion and the second heat treatment, the metal seamless pipe (103) is placed in the rollers (85), and forms a closed deformation hole with the rolling mandrels (86); the metal seamless pipe (103) is plastically deformed in the closed deformation hole while the metal crystal grains of the metal seamless pipe (103) are crushed; during rolling, the rollers (85) translate horizontally while rotating oppositely, thereby pushing the metal seamless pipe (103) to extend in a longitudinal direction; at extreme positions of the rollers (16), the rolling mandrels (86) rotate for advancing the metal seamless pipe (103); a rotation range of the rolling mandrels (86) is 0°-60°, and a pipe advancing volume per each pass is 0-3 mm; after the precise cold-rolling, a maximum deformation of the metal seamless pipe (103) is 20%, a metal pipe crystal grain size grade is 7-9, a wall thickness tolerance is ≤5%, an external diameter roundness error is 0 mm-0.05 mm, a wall thickness unevenness is ≤5%, and a straightness is ≤0.15 mm/m; a quantity of the rollers (85) in the multi-roller cold-rolling mill is three, four, five or six.

4. The method, as recited in claim 1, wherein when a ratio of a diameter D to a wall thickness h of the metal seamless pipe (103) with the reduced diameter obtained after the steps 1-7 is D/h<10, at least one of a step Z1 and a step Z2 is inserted after the step 7 to reduce the diameter and a wall thickness, and then a step Z3 and a step Z4 are inserted before performing the steps 8-14;

Z1) performing warm-drawing to reduce the diameter: synchronically performing electromagnetic induction heating and warm-drawing to the metal seamless pipe (103) with the reduced diameter, which mainly reduces the diameter and secondarily reduces the wall thickness, thereby obtaining the metal seamless pipe (103) whose diameter is reduced by the warm-drawing;

Z2) performing warm-expansion to reduce the wall thickness and increase the diameter: when a wall thickness reduction of the metal seamless pipe (103) after the warm-drawing fails production requirements, synchronically performing the electromagnetic induction heating and the warm-expansion to the metal seamless pipe (103) with the reduced diameter, which mainly reduces the wall thickness and secondarily reduces the diameter, thereby obtaining the metal seamless pipe (103) whose diameter is changed by the warm-drawing;

after at least one of the steps Z1 and Z2 is performed, if the metal seamless pipe (103) obtained by the warm-drawing or the warm-expansion fails diameter and wall thickness reduction requirements, then repeating at least one of the steps Z1 and Z2 for at least once until the metal seamless pipe (103) satisfies the diameter and wall thickness reduction requirements, and then performing the steps Z3 and Z4;

Z3) performing a second heat treatment: processing the metal seamless pipe (103) with the reduced diameter with the second heat treatment; and Z4) performing precise cold-rolling: after the second heat treatment, processing the metal seamless pipe (103) with small-deformation cold-rolling through a multi-roller cold-rolling technology;

if the metal seamless pipe (103) obtained by the step Z4 fails specification and performance requirements, repeating the steps Z3 and Z4 in sequence at least once until the metal seamless pipe (103) satisfies the specification and performance requirements.

5. The method, as recited in claim 4, wherein in the step Z1, the metal seamless pipe (103) with the reduced diameter is heated by a first induction heating device (81); a heating temperature is controlled at 50%-70% of an optimal hot working temperature of the metal seamless pipe (103), and an induction heating time is ≤30 S; the metal seamless pipe (103) is plastically deformed in a drawing die (82) which mainly reduces the diameter and secondarily reduces a wall thickness, so as to process the metal seamless pipe (103) with the warm-drawing; a taper angle of a necking core head die of the drawing die (82) is 5°-25°, and a length of a core head sizing belt is 3%-50% of the diameter of the metal seamless pipe (103); a single-pass diameter expansion capacity is 0%-25% of the diameter of the metal seamless pipe (103), and a single-pass wall thickness reduction is-10%-+15% of the wall thickness of the metal seamless pipe (103); an induction heating temperature range of the first induction heating device (81) is 0° C.-1600° C.;

in the step Z2, the metal seamless pipe (103) after the warm-drawing is heated by a second induction heating device (83); a heating temperature is controlled at 50%-70% of the optimal hot working temperature of the metal seamless pipe (103), and an induction heating time is ≤30 S; the metal seamless pipe (103) is plastically deformed in an expansion die (84) which mainly reduces the wall thickness and secondarily reduces the diameter, to process the metal seamless pipe (103) with the warm-expansion; a taper angle of a core die of the expansion die (84) is 5°-25°, and a length of a core head sizing belt is 10 mm-300 mm; a single-pass diameter expansion capacity is 0%-20% of the diameter of the metal seamless pipe (103), and a single-pass wall thickness reduction is 0%-15% of the wall thickness of the metal seamless pipe (103); an induction heating temperature range of the second induction heating device (83) is 0° C.-1600° C.

6. The method, as recited in claim 1, wherein in the step 3, the external wall of the hollow blank pipe (102) is ground by a grinding wheel head (3) to eliminate oxide scales and spiral joints left on the external wall by drilling; the grinding wheel head (3) is divided into a large-grain coarse grinding wheel head, a medium-grain emery cloth head, and a fine-grain grinding wheel head; the large-grain grinding wheel head is used to eliminate the spiral joints on the external wall of the hollow blank pipe (102), the medium-grain emery cloth head is used to grind metal burrs caused by the large-grain coarse grinding wheel head, and the fine-grain grinding wheel head is used to polish the external wall of the hollow blank pipe (102); a grinding thickness of the grinding wheel head (3) is 0.1 mm-10 mm, a roundness error after grinding is 0-0.05 mm, a hole diameter deviation is ±0.01 mm, a surface finish satisfies a Ra0.2 standard;

in the step 4, the internal wall of the hollow blank pipe (102) is ground by a wire grinding head (4) to eliminate oxide scales as well as deflection and interlayer problems left on the internal wall by drilling; a grinding thickness of the wire grinding head (4) is 0.1 mm-5 mm, a steel wire diameter of the wire grinding head (4) is ≤0.1 mm;

in the step 5, the hollow blank pipe (102) is soaked in an alkaline cleaning solution to clean the internal and external walls, thereby removing surface grinding head grits, metal burrs, and oil stains; the hollow blank pipe (102) is overturned 3-5 times in the alkaline cleaning solution, a soaking time is 5-10 minutes, and a pH value of the alkaline cleaning solution is 8-10.

7. The method, as recited in claim 1, wherein in the step 6, an oblique straightening method is adopted, or a combined method comprising pressure straightening and oblique straightening is adopted; wherein for the hollow blank pipe (102) with a diameter of less than 350 mm and a ratio of the diameter to a wall thickness of greater than 25, the oblique straightening method is used to eliminate deflection and flattening deformation of the hollow blank pipe (102); or for the hollow blank pipe (102) with a diameter of greater than 350 mm and a ratio of the diameter to a wall thickness of less than 25, both the pressure straightening and the oblique straightening are used; the pressure straightening is used to eliminate bending deflection of the hollow blank pipe (102); the oblique straightening is used to eliminate the flattening deformation while eliminating a residual stress of the hollow blank pipe (102); a rotating indenter (62) of the oblique straightening contacts with the hollow blank pipe (102) in an obliquely rotating form, and a moving indenter (61) of the pressure straightening contacts with the hollow blank pipe (102) in a vertical form; after straightening, an external diameter roundness error of the hollow blank pipe (102) is 0-0.1 mm, and a straightness is ≤0.3 mm/m;

in the step 7, the straightened hollow blank pipe (102) is heated by a third induction heating device (74); an optimal warm-rolling temperature is determined according to an optimal hot working temperature of the metal seamless pipe (103), and an induction heating time is ≤30 S; and then a four-roller rolling mill is used for rolling; a rolling formation unit of the four-roller rolling mill is formed by four vertical rollers and a set of mandrels (71) with tapered surfaces; a top roller and a bottom roller of the four rollers are working rollers (72), and two middle rollers of the four rollers are supporting rollers (73) having continuous tapered section holes; the hollow blank pipe (102) is placed between the two supporting rollers (73), and forms a closed deformation hole with the mandrels (71); the hollow blank pipe (102) is plastically deformed in the deformation hole, and a deformation is no more than 50%; meanwhile, metal crystal grains of the hollow blank pipe (102) are crushed, and a crystal grain size grade is 4-9; during rolling, the two working rollers (72) translate horizontally and rotate oppositely, while the two supporting rollers (73) are kept in contact with the working rollers (72) to be driven; the four rollers coordinately push the hollow blank pipe (102) to extend longitudinally; at an extreme position of the four-roller rolling mill, the mandrels (71) rotate for advancing the hollow blank pipe (102); a rotation angle of the mandrels (71) is 0°-75°, and a pipe advancing volume per each pass is 0 mm-10 mm; after the four-roller warm-rolling, a maximum deformation of the hollow blank pipe (102) is up to 50%, a metal pipe crystal grain size grade is 5-7, a wall thickness tolerance is ≤7%, an external diameter roundness error is 0 mm-0.1 mm and ≤3%, a wall thickness unevenness is ≤5%, and a straightness is ≤0.2 mm/m; an induction heating temperature range of the third induction heating device (74) is 0° C.-1600° C.; during the four-roller warm-rolling, an induction heating temperature is set according to a melting point of the hollow blank pipe (102);

in the step 8, the metal seamless pipe (103) with the reduced diameter is soaked in an alkaline cleaning solution to remove surface oil stains; the metal seamless pipe (103) is overturned 3-5 times in the alkaline cleaning solution, a soaking time is 5-10 minutes, and a pH value of the alkaline cleaning solution is 8-10.

8. The method, as recited in claim 1, wherein in the step 9, the degreased metal seamless pipe (103) is transported into a bright cleaning furnace (9) through a furnace bottom conveyor belt (91), wherein four sets of furnace nozzles (92) are divided into an upper layer and a lower layer in the bright cleaning furnace (9), to ensure uniform heating of the metal seamless pipe (103); the bright cleaning furnace (9) is connected to a hydrogen generating device (93) which generates hydrogen, and the hydrogen undergoes combustion reaction with oxygen to provide heat energy for the bright cleaning furnace (9);

in the step 10, the external wall of the brightened metal seamless pipe (103) is ground with a fine-grain grinding wheel head (3) to eliminate surface quality problems of the metal seamless pipe (103) caused by surface oxide films and pass processes, a grinding thickness is 0.1 mm-1 mm, a roundness error after grinding is 0.01 mm-0.02 mm, a hole diameter deviation is ±0.01 mm, and a surface finish satisfies a Ra0.2 standard;

in the step 11, the internal and external walls of the metal seamless pipe (103) are cleaned with a negative pressure cleaning device (111), thereby removing surface grinding head grit and metal burrs.

9. The method, as recited in claim 1, wherein in the step 12, the high-performance difficult-to-deform metal seamless pipe (103) is processed with surface ultrasonic detection by using an eddy current flaw detection device (121), to obtain crack defect information of the metal seamless pipe (103) after large deformation for discarding the unqualified high-performance difficult-to-deform metal seamless pipe (103);

in the step 13, the qualified high-performance difficult-to-deform metal seamless pipe (103) is sampled through physical testing and chemical testing for analyzing mechanical properties, grain sizes, and corrosion resistance, and evaluating metal pipe performance; the steps 7-13 are repeated to the unqualified high-performance difficult-to-deform metal seamless pipe (103) until the qualified high-performance difficult-to-deform metal seamless pipe (103) is obtained.

* * * * *